US011304486B2

(12) United States Patent
Ayhan

(10) Patent No.: US 11,304,486 B2
(45) Date of Patent: Apr. 19, 2022

(54) SECURING DEVICE DESIGNED TO BE MOUNTED ON A WHEELED SUITCASE, AND CORRESPONDING AUXILIARY HOOKING ELEMENT

(71) Applicant: Servet Ayhan, Asnieres sur Seine (FR)

(72) Inventor: Servet Ayhan, Asnieres sur Seine (FR)

( * ) Notice: Subject to any disclaimer, the term of this patent is extended or adjusted under 35 U.S.C. 154(b) by 173 days.

(21) Appl. No.: 16/076,497

(22) PCT Filed: Feb. 6, 2017

(86) PCT No.: PCT/EP2017/052505
§ 371 (c)(1),
(2) Date: Aug. 8, 2018

(87) PCT Pub. No.: WO2017/137340
PCT Pub. Date: Aug. 17, 2017

(65) Prior Publication Data
US 2019/0037990 A1 Feb. 7, 2019

(30) Foreign Application Priority Data
Feb. 8, 2016 (FR) ..... 1650978

(51) Int. Cl.

| | |
|---|---|
| ***A45C 7/00*** | (2006.01) |
| ***A45C 5/14*** | (2006.01) |
| ***B65D 21/02*** | (2006.01) |
| ***A45C 5/03*** | (2006.01) |
| ***A45C 13/26*** | (2006.01) |

(52) U.S. Cl.
CPC ..... *A45C 7/0045* (2013.01); *A45C 5/03* (2013.01); *A45C 5/14* (2013.01); *A45C 13/262* (2013.01); *B65D 21/0201* (2013.01); *A45C 2013/267* (2013.01)

(58) Field of Classification Search
CPC ..... A45C 7/0045; A45C 5/03; A45C 5/14; A45C 13/262; B65D 21/0201
USPC ..... 220/23.4; 190/108, 102
See application file for complete search history.

(56) References Cited

U.S. PATENT DOCUMENTS

| | | | | |
|---|---|---|---|---|
| 3,823,973 | A | 7/1974 | Ramer | |
| 5,971,119 | A * | 10/1999 | Chi | A45C 7/0045 190/102 |
| 7,909,149 | B2 * | 3/2011 | Marji | A45C 7/0045 190/111 |
| 2015/0014949 | A1 * | 1/2015 | Dittman | A45C 7/0045 280/47.17 |
| 2015/0114777 | A1 * | 4/2015 | Edme | A45C 7/0045 190/18 A |

FOREIGN PATENT DOCUMENTS

| | | | | |
|---|---|---|---|---|
| DE | 102013103043 | * 10/2014 | ..... | A45C 7/10045 |

* cited by examiner

*Primary Examiner* — Don M Anderson
*Assistant Examiner* — Jennifer Castriotta
(74) *Attorney, Agent, or Firm* — Christensen O'Connor Johnson Kindness PLLC

(57) ABSTRACT

This securing device (22, 24), designed to be mounted on a wall (8) of a suitcase (2, 4, 102) with wheels (12), comprises a main hooking element suitable for being fastened to an auxiliary hooking element (26) incorporated into another suitcase (2, 4), and a detaching actuator capable of releasing the main hooking element from the auxiliary hooking element (26).

7 Claims, 4 Drawing Sheets

Figure 1:
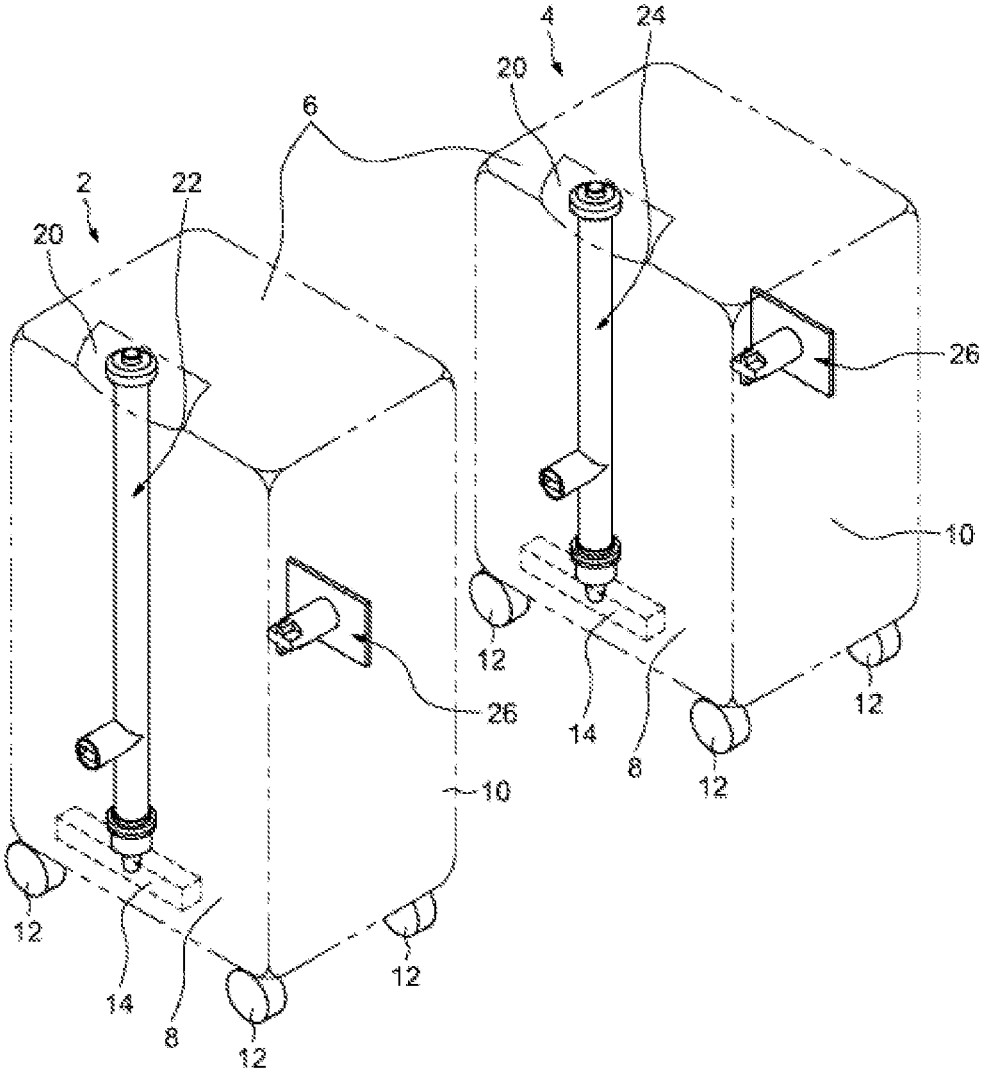

SECURING DEVICE DESIGNED TO BE MOUNTED ON A WHEELED SUITCASE, AND CORRESPONDING AUXILIARY HOOKING ELEMENT

The invention relates to the field of suitcases, and more particularly to that of suitcases provided with a plurality of wheels.

These days, many kinds of suitcases are known that can be used for traveling. Generally, a suitcase comprises a number of walls defining a space for placing therein the personal effects of the traveler.

To make it easier to transport such a suitcase, it is known practice to incorporate wheels in the suitcase, for example on a lateral or front wall of the suitcase. Advantageously, such a suitcase can comprise a plurality of wheels, that is to say at least three, and preferably four, so as to be able to be moved without requiring an effort on the part of the user to tilt the suitcase or keep the tilt of the suitcase constant.

Although such an arrangement is advantageous for the traveler, it is however not fully satisfactory for a traveler having to move a plurality of suitcases. Indeed, in this case, the user, who needs one hand for each suitcase, can only move two suitcases at a time. This arrangement is even less satisfactory when the user has to use one of his or her hands to hold another object, such as a telephone.

Given the above, there is a need to provide a means to allow a user to move a plurality of suitcases with wheels as simply as possible.

To this end, a securing device is proposed that is designed to be mounted on a wall of a suitcase with wheels, comprising a main attachment element capable of being fixed onto an auxiliary attachment element incorporated in another suitcase, and a releasing actuator capable of releasing the main attachment element from the auxiliary attachment element.

By virtue of such a securing device, it is possible for the user to move at least two suitcases provided with a plurality of wheels, as if he or she were moving only one. Furthermore, by virtue of the releasing actuator, the suitcases can be assembled or disassembled without that requiring the user to make several actions or be obliged to bend down, or even to go around the suitcase. The result thereof is a use which is more practical and more ergonomic for the user.

In one embodiment, the main attachment element comprises a protruding cylindrical part extending in a direction at right angles to the longitudinal direction of the suitcase.

Such a configuration comprising in particular a protruding cylindrical part allows for simple, intuitive and reliable assembly of at least two suitcases provided with a plurality of wheels.

A means for retracting the protruding cylindrical part can also be provided, said retraction means being capable of driving the protruding cylindrical part in rotation about the longitudinal direction of the suitcase.

Such an embodiment provided in particular with a retraction means is advantageous in that it makes it possible to prevent an increase in the dimensions of the suitcase, and therefore to create an additional bulk, when the securing device is not used.

According to another embodiment, the securing device comprises a hollow cylinder, means for fixing the hollow cylinder onto a frame of the suitcase, the fixing means comprising a pivot link element ensuring the mechanical link between a first end of the hollow cylinder and the fixing means, the main attachment element comprising a protruding cylindrical part secured to the hollow cylinder and extending in a direction at right angles to the axial direction of the hollow cylinder, and a hooking element arranged inside the protruding cylindrical part, the hollow cylinder comprising, at a second end opposite the first end, a device for manually actuating the pivoting of the hollow cylinder.

Advantageously, the hollow cylinder comprises, at its second end, a through orifice provided to contain a guiding pin of a telescopic handle of the suitcase.

Preferably, the releasing actuator comprises an abutment capable of being moved in translation in the longitudinal direction of the hollow cylinder and inside the hollow cylinder, the protruding cylindrical part comprising an open orifice intended to receive an attachment rod of the auxiliary attachment element, the hooking element comprising a tongue with flexural elastic behavior, fixed at one of its ends to the protruding cylindrical part and in contact, at the other of its ends, with the abutment, said tongue comprising a hook-forming portion intended to cooperate with a recess formed in the attachment rod.

According to another aspect, an auxiliary attachment element is designed to be incorporated in a suitcase with wheels, comprising means for fixing the auxiliary attachment onto a wall of the suitcase, and attachment means designed to be fixed to a main attachment element of a securing device incorporated in another suitcase.

In one embodiment, the attachment means comprise a cylindrical housing intended to receive a protruding cylindrical part of the securing device, the fixing means making it possible to fix the auxiliary attachment element such that the axial direction of the cylindrical housing is at right angles to the plane of the wall of the suitcase, the attachment means further comprising an attachment rod extending inside the cylindrical housing and parallel to the axial direction of the cylindrical housing, the attachment rod further comprising a recess capable of cooperating with a hooking element provided inside a protruding cylindrical part of the securing device.

According to yet another aspect, there is proposed a suitcase with wheels, comprising a front wall and a rear wall both extending facing one another, and a securing device as defined previously and/or an auxiliary attachment element as defined previously.

Advantageously, such a suitcase comprises, on its rear wall, a securing device as described previously and, on its front wall, an auxiliary attachment element as described previously. This arrangement is notably advantageous, in that it makes it possible to place the releasing device in proximity to a handle of the suitcase, the handle of the suitcase being generally situated on a top wall in proximity to the rear wall. The result thereof is a handling of the suitcase and of the securing device that is even more practical for the user.

In a preferential embodiment, the ground clearance, that is to say the distance between the plane containing the points of contact with the ground of the wheels, and the main attachment element and/or the auxiliary attachment element is substantially the same, and preferably between 15 cm and 35 cm, and preferably between 20 cm and 27 cm.

Figure 2:
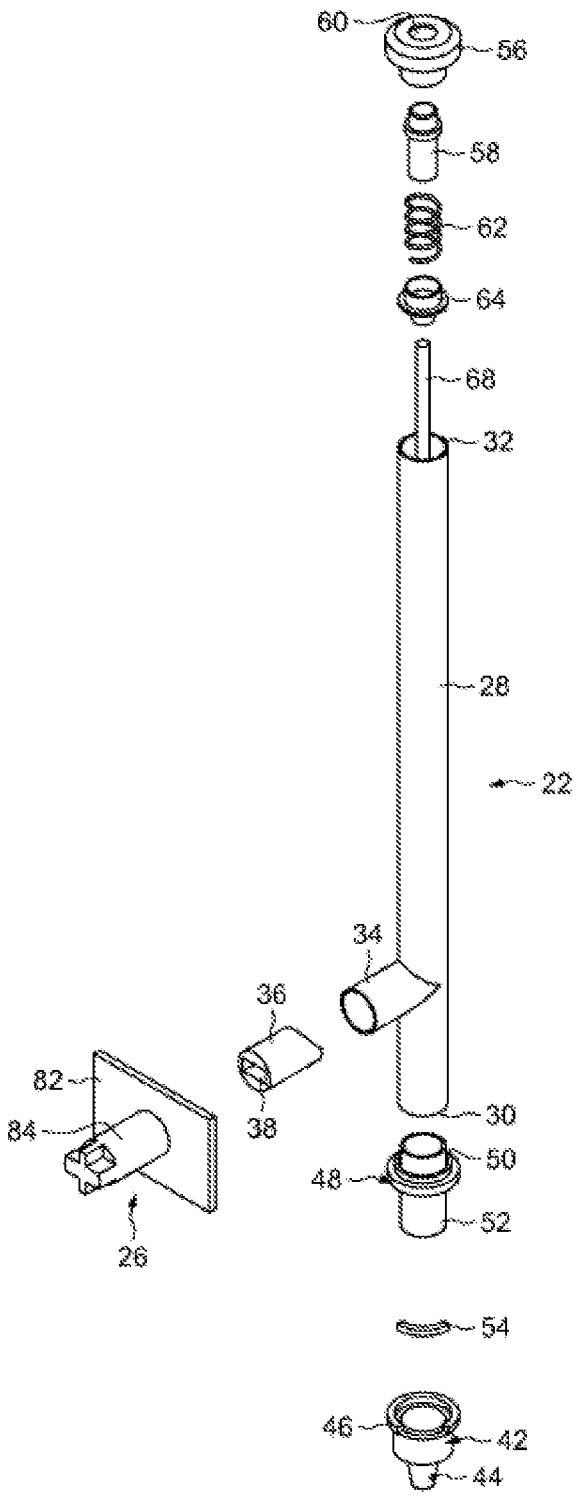
Figure 3:
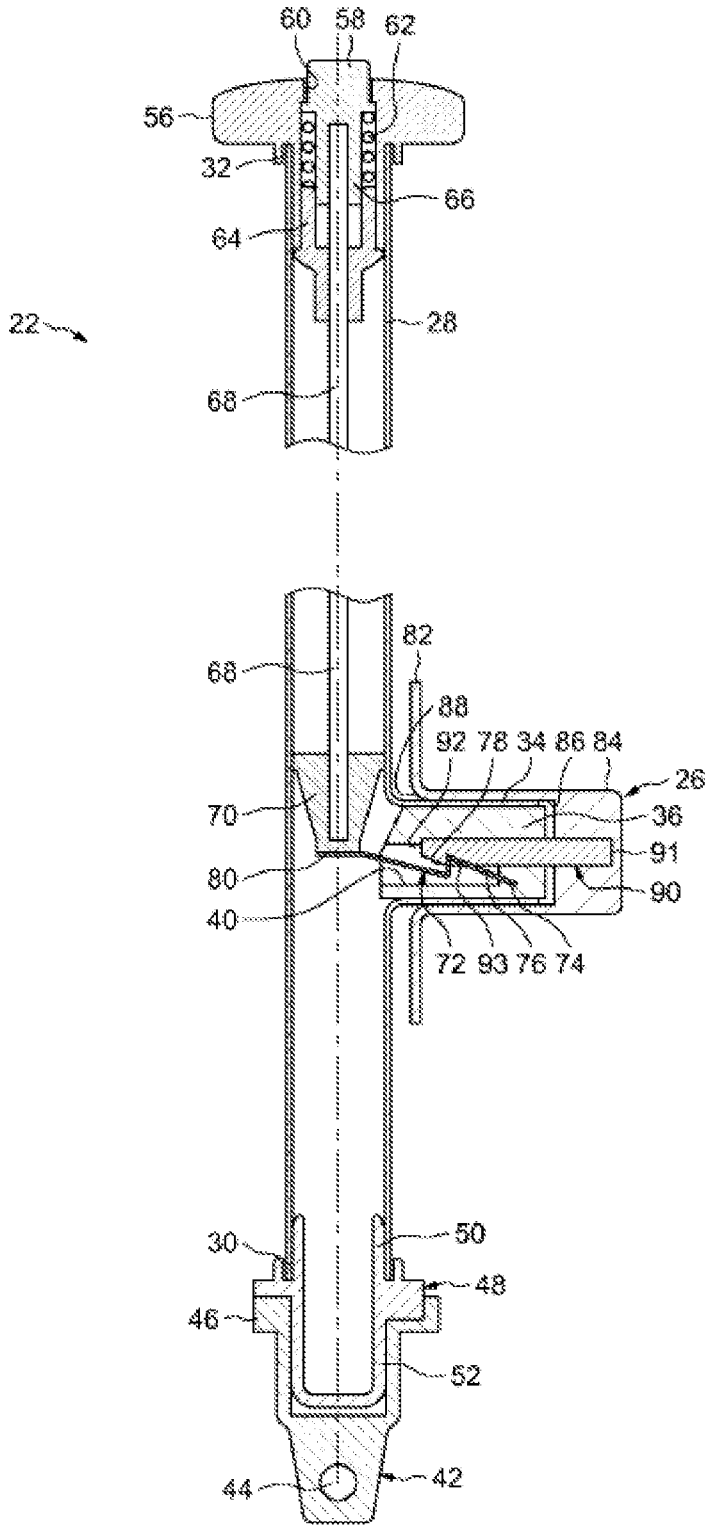
Figure 4:
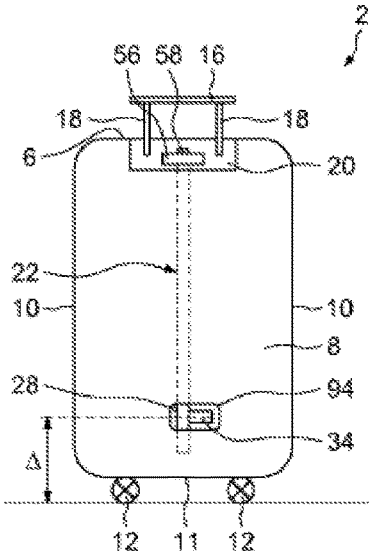
Figure 5:
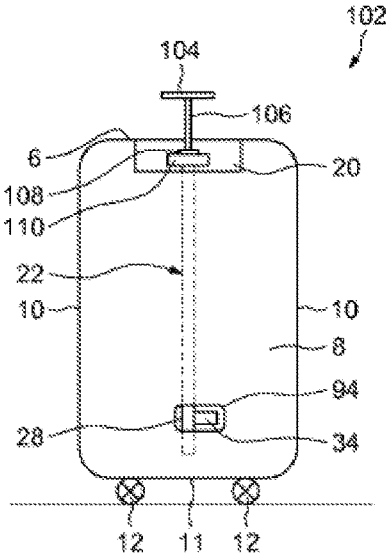

Other advantages and features of the invention will become apparent on examining the detailed description of nonlimiting embodiments of the invention, and the attached drawings, in which:

FIG. 1 represents a perspective schematic view of two suitcases each equipped with a securing device and an auxiliary attachment element according to a first embodiment of the invention, FIG. 2 is a perspective exploded representation of one of the securing devices and of one of the auxiliary attachment elements represented in FIG. 1, FIG. 3 is a cross-sectional view of the securing device and of the auxiliary attachment element of FIG. 2, FIG. 4 is a rear view of one of the suitcases represented in FIG. 1, and FIG. 5 is a profile schematic view of a suitcase according to a second embodiment of the invention.

In FIG. 1, two suitcases 2 and 4 are represented, each comprising a top wall 6, a rear wall 8, two lateral walls 10, a front wall (not visible) and a bottom wall 11.

Each of the suitcases 2 and 4 comprises four wheels 12, distributed and fixed at the four corners of the bottom wall 11. More particularly, each of the wheels 12 is capable of pivoting, relative to the bottom wall 11, about its own axis of cylindricality. Advantageously, the wheels 12 are also capable of pivoting, relative to the bottom wall 11, about an axis at right angles to the axis of the wall 11. The result thereof is the possibility of moving the suitcase in translation in any horizontal direction, and in rotation about the longitudinal axis of the suitcase.

The wheels 12 are intended to rest on the ground according to a spot contact, at the end point situated furthest from the bottom wall 11. When the wheels rest on a flat and horizontal ground, the longitudinal axis of the suitcases 2 and 4 coincides with the vertical axis. Obviously, it is possible to envisage, without departing from the scope of the invention, having the wheels 12 fixed onto a bottom part of the front wall, of the rear wall 8 or of one of the lateral walls 10, or even to any element situated within these walls, it being understood that said bottom part is situated in proximity to the bottom wall 11.

Each of the suitcases 2 and 4 comprises a frame of which one frame element 14 is represented in FIG. 1. The frame element 14 comprises a beam portion of a metal frame of the suitcase, said beam portion being situated at the edge between the rear wall 8 and the bottom wall 11. Furthermore, each of the suitcases 2 and 4 comprises a removable handle 16 (see FIG. 4), secured to two handle prongs 18. The handle 16 can be inserted into a handle base 20, provided at the edge between the top wall 6 and the rear wall 8.

As can be seen in FIG. 1, the suitcase 2 here has dimensions greater than those of the suitcase 4. In particular, the suitcase 4 is smaller in its longitudinal direction compared to the suitcase 2. In other words, the front wall, the rear wall 8 and the lateral walls 10 have been reduced over their length.

The suitcase 2 comprises a securing device 22 mounted on its rear wall 8. Similarly, the suitcase 4 comprises a securing device 24 mounted on its rear wall 8. The suitcases 2 and 4 each comprise an auxiliary attachment element 26 mounted on their front wall.

Referring to FIGS. 2 and 3, the securing device 22 is represented respectively in exploded view and in cross section.

The securing device 22 is composed in particular of a hollow cylinder 28, of oblong form, of circular section and comprising a first end 30 and a second end 32. The hollow cylinder 28 comprises a radial protuberance 34, which is hollow and of circular section. The radial protuberance 34 extends in the radial direction of the cylinder 28. The hollow cylinder 28 is preferably made of a single piece, is composed of a light material, such as aluminum, polyvinyl chloride (PVC) or acrylonitrile butadiene styrene (ABS).

The securing device comprises a main attachment element comprising a protruding cylindrical part 36 arranged inside the radial protuberance 34. In the present application, the main attachment element is defined as being the internal volume of the radial protuberance 34 and the components of the securing device which are situated inside this volume. The protruding cylindrical part 36 is preferably made of a material containing plastic. The cylindrical part 36 comprises an orifice 38, of rectangular section, emerging in a recess 40 (see FIG. 3).

At the first end 30 of the hollow cylinder 28, the securing device 22 comprises a fixing end-fitting 42, provided in order to fix said first end 30 to the frame element 14. To this end, the fixing end-fitting 42 comprises a bottom end in which is formed an open hole 44 provided for the passage of the frame element 14. The fixing means 42 comprises a top outer ring 46, delimiting a cylindrical orifice.

The securing device 22 comprises a pivot link element 48, comprising a top part 50. The top part 50 allows for the attachment of the hollow cylinder 28 to the element 48. Opposite, the element 48 comprises a bottom portion forming an inner ring 52 that can be inserted into the cylindrical orifice delimited by the outer ring 46. The element 48 and the outer ring 46 are preferably formed in a material exhibiting a low friction coefficient, such as copper. In this way, the hollow cylinder 28 is capable of pivoting about its own axis of cylindricality, relative to the fixing end-fitting 42. The hollow cylinder 28 and its radial protuberance 34 are thus capable of pivoting about the axis of the cylinder 28, relative to the suitcase 2.

The pivot link forming element 48 further comprises an abutment element 54 (see FIG. 2), by means of which the rotation of the cylinder 28 about its axis is limited to 90°. More particularly, the abutment element 54 is arranged so as to allow the hollow cylinder 28 and the radical protuberance 34 to pivot, only, between an extended position, in which the radial protuberance 34 is at right angles to the plane of the wall 8, and an inset position, in which the radial protuberance 34 is oriented in a direction parallel to the plane of the rear wall 8.

At the second end 32, the securing device 22 comprises a device for manually actuating the pivoting of the cylinder 28. The pivoting actuation device comprises a knob 56, secured to the cylinder 28. A user can thus, by manually manipulating said knob 56, drive the pivoting of the cylinder 28, relative to the fixing means 42.

Still at the end 32, the securing device 22 comprises a releasing actuator composed in particular of a pushbutton 58, inserted into a cylindrical orifice 60 formed inside the knob 56. The pushbutton 58 is linked, via a compression spring 62, to a spring abutment 64 secured to the cylinder 28. The pushbutton 58 comprises an axially protruding end 66, surrounded by the spring 62, and defining an inner bore provided to receive a cylindrical releasing rod 68. The axially protruding end 66 is long enough to be able to come into contact against a front face of the spring abutment 64. In this way, a user who presses the pushbutton 58 feels, initially, a first sensation of progressively increasing feedback due to the compression of the spring and next, a second sensation of much greater feedback, resulting from the surface contact between the axially protruding element 66 and the front surface of the abutment 64.

The rod 68 extends, from the pushbutton 58, inside the hollow cylinder 28 and parallel to the axial direction of said cylinder 28. The rod 68 is secured, at its end opposite that in contact with the button 58, to a releasing abutment 70. The releasing abutment 70 is situated inside the hollow cylinder 28, capable of being moved in translation relative to the axial direction of said cylinder 28 and situated substantially level with the radial protuberance 34 (see FIG. 3).

The securing device 22 comprises a hooking element, composed in particular of a tongue 72 (see FIG. 3). The tongue 72 is produced in a metal material with flexural elastic behavior, such as steel. The tongue 72 is oriented such that its longitudinal direction is parallel to the radial direction of the hollow cylinder 28. Preferably, the tongue 72 has a width of between 1 cm and 2 cm.

As can be seen in FIG. 3, the tongue 72 comprises (from right to left in FIG. 3) a first portion 74 thermoformed in the plastic material constituting the protruding cylindrical part 36; a bending spring-forming second portion 76; a hook-forming third portion 78; and a fourth portion 80 fixed to the releasing abutment 70.

The second portion 76 and the third portion 78 of the tongue 72 are contained in the recess 40. The tongue 72 is represented in its position of balance in FIG. 3.

Also represented in FIGS. 2 and 3 is an auxiliary attachment element 26 according to one aspect of the invention.

The auxiliary attachment element 26 comprises fixing means, notably composed of a plate 82. The plate 82 makes it possible to fix said attachment element 26 onto the front wall or the rear wall 8 of the suitcase with wheels 2 or 4.

The auxiliary attachment element 26 is moreover provided with attachment means intended to cooperate with the main attachment element of the securing device 22, that is to say with the axial protuberance 34 and what it contains. The attachment means comprise a cylindrical tube 84 extending in a direction at right angles to the plane of the plate 82. The cylindrical tube 84 defines a cylindrical housing 86 capable of receiving the radial protuberance 34 and the protruding cylindrical part 36. The edge between the cylindrical housing 86 and the plate 82 can comprise a chamfer and/or a rounding 88 (see FIG. 3), so as to more easily accommodate the radial protuberance 34 and the cylindrical part 36.

The attachment means further comprise an attachment rod 90 (see FIG. 3), of circular section and of a length substantially equal to the length of the cylindrical tube 84. However, there is no departure from the scope of invention by using an attachment rod of different section, such as, for example, a square, oval or even rectangular section. The attachment rod 90 comprises a first end 91 embedded or thermoformed in the material forming the cylindrical tube 84. Outside the part adjacent to the end 91, the attachment rod 90 is conformed to be able to be inserted inside the open orifice 38 of the protruding cylindrical part 36. The attachment rod 90 comprises a beveled end 92, opposite the end 91. The attachment rod 90 comprises a recess 93, adjacent to the beveled end and provided to cooperate with the hook-forming portion 78 of the tongue 72. For this, the recess 93 is of a form complementary to that of the hook-forming part 78, that is to say with a surface oriented at right angles to the axial direction of the rod 90 and an oblique surface.

The securing device 24 represented in FIG. 1 is similar to the securing device 22, and will not be explained in as much detail as the securing device 22. The securing device 24 does however differ from the securing device 22, in that, for the securing device 24, the length of the hollow cylinder 28 is shorter than for the securing device 22. The same applies for the length of the rod 68. More particularly, it is the length of the portion of the cylinder 28, included between the radial protuberance 34 and the second end 32, which is shorter in the securing device 24, the portion contained between the first end 30 and the protuberance 34 being of the same length for both devices.

In this way, for each of the securing devices 22 and 24, the main attachment elements, composed in particular of the radial protuberance 34 and of the protruding cylindrical part 36, are situated substantially with the same ground clearance A (see FIG. 4). In other words, when the suitcases 2 and 4 are arranged such that the wheels 12 all rest on the ground, as represented in FIG. 4, the main attachment elements are situated at one and the same distance A from the plane formed by the ground. Likewise, the auxiliary attachment elements 26 are respectively fixed to the suitcases 2 and 4, so as to have the same ground clearance A as the main attachment elements of the devices 22 and 24. Preferably, the ground clearance A lies between 15 cm and 35 cm. Even more advantageously, the ground clearance A lies between 20 cm and 27 cm, and preferably between 21 cm and 23 cm.

Referring to FIG. 4, the suitcase 2 is represented in a rear view. In this schematic view, the part of the securing device 22 concealed by the rear wall 8 has been represented by dotted lines.

The rear wall 8 comprises a housing 94, of substantially rectangular form and formed at the same height as the radial protuberance 34. More particularly, the housing 94 is conformed so as to be able to accommodate the radical protuberance 34, when the hollow cylinder 28 is pivoted by a quarter turn in its inset position. The housing 94 is conformed such that, when the cylinder 28 is oriented in its extended position, the radial protuberance 34 extends protrudingly outward relative to the surface of the rear wall 8, and that, when the cylinder 28 is oriented according to its inset position, the radical protuberance 34 is fully contained in the housing 94.

In this way, the securing devices 22 and 24, in cooperation with the auxiliary attachment element 26, make it possible to secure the suitcases 2 and 4 together, as well as any other suitcase with wheels comprising a securing device and/or an auxiliary attachment element as described previously. A user can then move the assembly composed of several suitcases using a single hand.

Furthermore, the fixing is done simply, by snap-fitting of the bending spring formed by the tongue 72 into the recess 92. Such fixing also offers the advantage of being solid.

By means of the releasing actuator, the user can easily, by simply pressing the pushbutton 58, disengage the hook-forming portion 78 from the recess 93, so as to separate the two suitcases.

The result thereof is that the user can secure or separate several suitcases simply, and in particular without needing to bend down or go around one of the suitcases.

By virtue of the fact that, in each case, and independently of the dimensions of the suitcase, the main or auxiliary attachment element is arranged with one and the same ground clearance, it is possible to assemble together suitcases of different dimensions and/or models, while guaranteeing reliable fixing and good stability of the assembly. A ground clearance value of between 20 cm and 27 cm makes it possible to ensure the ability to assemble suitcases of very different dimensions, while ensuring good stability.

By virtue of the pivot link-forming element 48 and the knob 56, a means for retracting the radial protuberance 34 and the protruding cylindrical part 36 is provided. The invention then creates a limited bulk, a suitcase according to the invention not having greater bulk, when the radial protuberance 34 is in its inset position, than a conventional suitcase. Any damage to elements of the suitcase, such as, for example, when the suitcase is being transported in a baggage compartment, is also avoided.

Moreover, without departing from the scope of the invention, it is possible to consider the suitcase having a different number of wheels. For example, such a suitcase can have three wheels, advantageously arranged according to a triangular arrangement, or five wheels, or more. In the present application, the term "a plurality of wheels" is understood to mean that the number of wheels must be at least equal to three.

FIG. 5 shows a suitcase 102 according to a second embodiment of the invention. The elements that are identical bear the same references.

As represented in FIG. 5, the suitcase 102 differs from the suitcase 2, in that it comprises a telescopic handle 104 secured to a single guiding prong 106.

The securing device 22 comprises a pushbutton 108 and a knob 110 arranged respectively in place of the pushbutton 58 and the knob 56. An orifice (not represented) is provided in the parts 108 and 110 for the passage of the prong 106. To this end, the width of the pushbutton 108 is greater than the width of the pushbutton 58.

In this way, the prong 106 of the handle 104 can be slidingly mounted inside the pushbutton 108 and the knob 110, which allows for a further space saving and a cost-effectiveness gain.

The invention claimed is:

1. A securing device designed to be mounted on a wall of a suitcase with wheels, comprising a main attachment element capable of being fixed onto an auxiliary attachment element incorporated in another suitcase, and a releasing actuator capable of releasing the main attachment element from the auxiliary attachment element, the main attachment element comprising a protruding cylindrical part extending in a direction at a right angle to the longitudinal direction of the suitcase, the securing device comprising a means for retracting the protruding cylindrical part, said retraction means being capable of driving the protruding cylindrical part in rotation about the longitudinal direction of the suitcase.

2. The securing device as claimed in claim 1, comprising a hollow cylinder, means for fixing the hollow cylinder onto a frame of the suitcase, the fixing means comprising a pivot link element ensuring the mechanical link between a first end of the hollow cylinder and the fixing means, the main attachment element comprising a protruding cylindrical part secured to the hollow cylinder and extending in a direction at a right angle to the axial direction of the hollow cylinder, and a hooking element arranged inside the protruding cylindrical part, the hollow cylinder comprising, at a second end opposite the first end, a device for manually actuating the pivoting of the hollow cylinder.

3. The securing device as claimed in claim 2, in which the hollow cylinder comprises, at its second end, a through orifice provided to contain a guiding pin of a telescopic handle of the suitcase.

4. The securing device as claimed in claim 2, in which the releasing actuator comprises an abutment capable of being moved in translation in the longitudinal direction of the hollow cylinder and inside the hollow cylinder, the protruding cylindrical part comprising an open orifice intended to receive an attachment rod of the auxiliary attachment element, the hooking element comprising a tongue with flexural elastic behavior, fixed at one of its ends to the protruding cylindrical part and in contact, at the other of its ends with the abutment, said tongue comprising a hook-forming portion intended to cooperate with a recess formed in the attachment rod.

5. A suitcase with wheels comprising a front wall and a rear wall both extending facing one another, said suitcase comprising a securing device as claimed in claim 1.

6. An auxiliary attachment element designed to be incorporated in a first suitcase with wheels, comprising:

fixing means for fixing the auxiliary attachment element onto a wall of the first suitcase, wherein the fixing means comprises a pivot link element, and an attachment means designed to be fixed to a main attachment element of a securing device incorporated in a second suitcase, the attachment means comprising a cylindrical housing for receiving a protruding cylindrical part of the securing device when the protruding cylindrical part is pivoted by a retraction means of the securing device in a position in which it is perpendicular to a plane of a wall of the second suitcase, in which the fixing means fix the auxiliary attachment element such that an axial direction of the cylindrical housing is at a right angle to the plane of the wall of the first suitcase, the attachment means further comprising an attachment rod extending inside the cylindrical housing and parallel to the axial direction of the cylindrical housing, the attachment rod further comprising a recess capable of cooperating with a hooking element provided inside the protruding cylindrical part of the securing device of the second suitcase.

7. A suitcase with wheels comprising a front wall and a rear wall both extending facing one another, said suitcase comprising an auxiliary attachment element as claimed in claim 6.

* * * * *